United States Patent [19]

Iida et al.

[11] Patent Number: 4,642,141

[45] Date of Patent: Feb. 10, 1987

[54] METHOD FOR PRODUCING GRAIN-ORIENTED SILICON STEEL SHEETS

[75] Inventors: Yoshiaki Iida; Katsuo Iwamoto, both of Chiba, Japan

[73] Assignee: Kawasaki Steel Corporation, Kobe, Japan

[21] Appl. No.: 738,019

[22] Filed: May 24, 1985

[30] Foreign Application Priority Data

May 24, 1984 [JP] Japan ..... 59-103696
Jun. 5, 1984 [JP] Japan ..... 59-113790
Mar. 8, 1985 [JP] Japan ..... 60-44940

[51] Int. Cl.[4] ..... H01F 1/04

[52] U.S. Cl. ..... 148/113; 148/111; 148/28

[58] Field of Search ..... 148/111, 112, 113, 27, 148/28

[56] References Cited

U.S. PATENT DOCUMENTS 3,932,201 1/1976 Steger ..... 148/27
3,956,030 5/1976 Lee et al. ..... 148/27
4,171,994 10/1979 Miller ..... 148/111

FOREIGN PATENT DOCUMENTS 48-48567 11/1981 Japan .
59-89725 5/1984 Japan ..... 148/27

*Primary Examiner*—John P. Sheehan
*Attorney, Agent, or Firm*—Balogh, Osann, Kramer, Dvorak, Genova & Traub

[57] ABSTRACT

A grain-oriented silicon steel sheet having high magnetic induction and low iron loss can be obtained by adhering uniformly at least one member selected from the group consisting of elements of Ge, Sn, Pb, As, Bi and Zn and compounds containing these elements to the surfaces of a silicon steel sheet before or after the decarburization annealing in a method for producing grain-oriented silicon steel sheets. According to this method, a hot rolled steel sheet is subjected to at least one cold rolling, the finally cold rolled steel sheet is subjected to a decarburization annealing, and the decarburized steel sheet is applied with an annealing separator consisting mainly of MgO and then subjected to a final annealing, or by carrying out the adhesion treatment of element in combination with a preliminary annealing before the decarburization annealing in the above described method, or by using the annealing separator further containing Bi or a Bi-containing compound in the above described method.

12 Claims, 8 Drawing Figures

METHOD FOR PRODUCING GRAIN-ORIENTED SILICON STEEL SHEETS

BACKGROUND OF THE INVENTION (1) Field of the Invention

The present invention relates to a method for producing grain-oriented silicon steel sheets, and particularly relates to a method for producing grain-oriented silicon steel sheets having low iron loss without lowering their magnetic induction.

(2) Description of the Prior Art

Grain-oriented silicon steel sheets are required to have high magnetic induction and low iron loss. There have been proposed various methods for lowering the iron loss, for example, a method wherein a steel having a high Si content is used; a method wherein a product steel sheet having a small thickness is produced; a method wherein secondary recrystallization grains highly aligned to (110)[001] orientation, that is, to Goss orientation are developed; a method wherein secondary recrystallization grains having small size are developed; and the like. As the method for developing secondary recrystallization grains highly aligned to Goss orientation, there have been known, for example, a method disclosed in Japanese Patent Application Publication No. 15,644/65, wherein an Al-containing silicon steel sheet is cold rolled at a high final reduction rate; a method disclosed in Japanese Patent Laid-open Specification No. 12,614/77 and the like, wherein a silicon steel having a very small B content is used; a method disclosed in Japanese Patent Application Publication No. 13,469/76, wherein an Sb-containing silicon steel sheet is subjected to a secondary recrystallization annealing at a low temperature; a method disclosed in Japanese Patent Application Publication No. 38,652/81, wherein a cold rolled steel sheet having a final gauge is annealed at a temperature within the range of 600°–650° C. for 0.5–10 minutes before the steel sheet is subjected to a decarburization annealing; a method disclosed in Japanese Patent Laid-open Specification No. 151,423/83, wherein a cold rolled steel sheet is heated at a heating rate of 100° C./min.–400° C./min. within the temperature range of 600°–700° C. in the heating stage in the decarburization annealing to keep the rate of recrystallization of the steel sheet to about 50%; and the like.

According to these methods, the secondary recrystallized grains are surely and highly aligned to Goss orientation, and as a result a grain-oriented silicon steel sheet having high magnetic induction can be obtained but the secondary recrystallized grains have always coarse grain size, and the resulting grain-oriented silicon steel sheet still has not satisfactorily low iron loss.

While, when it is intended to develop secondary recrystallization grains having a small grain size, not only crystal grains aligned to Goss orientation, but also crystal grains deviated from the Goss orientation grow as secondary recrystallization grains. Therefore, the resulting grain-oriented silicon steel sheet has low magnetic induction and high iron loss.

SUMMARY OF THE INVENTION

The object of the present invention is to obviate the drawbacks of the above described conventional techniques and to provide a method for producing always stable grain-oriented silicon steel sheets having excellent magnetic properties, wherein secondary recrystallization grains highly aligned to Goss orientation are developed and further the crystal grains are developed into a small size without forming into coarse grain size, thereby the iron loss of the product steel sheet is lowered.

The inventors have made various investigations in order to solve the above described problems and found out that the above described object can be very effectively attained by the following methods, i.e., a method, wherein at least one member selected from the group consisting of elements of Ge, Sn, Pb, As, Bi and Zn and compounds containing these elements is adhered to the surfaces of a finally cold rolled steel sheet before the decarburization annealing, or after the decarburization annealing and before the application of an annealing separator during the course of the production of a grain-oriented silicon steel sheet; a method wherein a step for subjecting a finally cold rolled steel sheet to a preliminary annealing at a temperature within the range of 500°–700° C. and a step for adhering at least one member selected from the group consisting of elements of Ge, Sn, Pb, As, Bi and Zn and compounds containing these elements to the surfaces of a finally cold rolled steel sheet are carried out before the decarburization annealing of the finally cold rolled steel sheet during the course of the production of a grain-oriented silicon steel sheet; and a method wherein an annealing separator consisting mainly of MgO and further containing Bi or a compound containing Bi is applied to the surfaces of a decarburized steel sheet before the secondary recrystallization annealing during the course of the production of a grain-oriented silicon steel sheet.

The present invention is based on the above described discoveries.

The first aspect of the present invention lies in a method for producing grain-oriented silicon steel sheets, wherein a hot rolled silicon steel sheet containing at least one of S, Se and Te as an inhibitor for the growth of primary recrystallization grains is occasionally subjected to an annealing and is then subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising adhering uniformly at least one member selected from the group consisting of elements of Ge, Sn, Pb, As, Bi and Zn and compounds containing these elements to the surfaces of the finally cold rolled steel sheet before the decarburization annealing.

The second aspect of the present invention lies in a method for producing grain-oriented silicon steel sheets, wherein a hot rolled silicon steel sheet containing at least one of S, Se and Te as an inhibitor for the growth of primary recrystallization grains is occasionally subjected to an annealing and is then subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising adhering uniformly at least one member selected from the group consisting of elements of Ge, Sn, Pb, As, Bi and Zn and compounds containing these elements to the surfaces of the decarburized steel sheet before the application of an annealing separator to the steel sheet surfaces.

The third aspect of the present invention lies in a method for producing grain-oriented silicon steel sheets, wherein a hot rolled silicon steel sheet containing at least one of S, Se and Te as an inhibitor for the growth of primary recrystallization grains is occasionally subjected to an annealing and is then subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising carrying out a step for subjecting the finally cold rolled steel sheet to a preliminary annealing at a temperature within the range of 500°–700° C., and a step for adhering at least one member selected from the group consisting of elements of Ge, Sn, Pb, As, Bi and Zn and compounds containing these elements to the surfaces of the finally cold rolled steel sheet, before the finally cold rolled steel sheet is subjected to the decarburization annealing.

The fourth aspect of the present invention lies in a method for producing grain-oriented silicon steel sheets, wherein a hot rolled silicon steel sheet containing at least one of S, Se and Te as an inhibitor for the growth of primary recrystallization grains is occasionally subjected to an annealing and is then subjected to at least one cold rolling, the finally cold rolled steel sheet is subjected to a decarburization annealing, and the decarburized steel sheet is applied with an annealing separator consisting mainly of MgO and then subjected to a final annealing, the improvement comprising the annealing separator further containing at least one of Bi and compounds containing Bi.

DESCRIPTION OF THE PREFERRED EMBODIMENT

Figure 1:
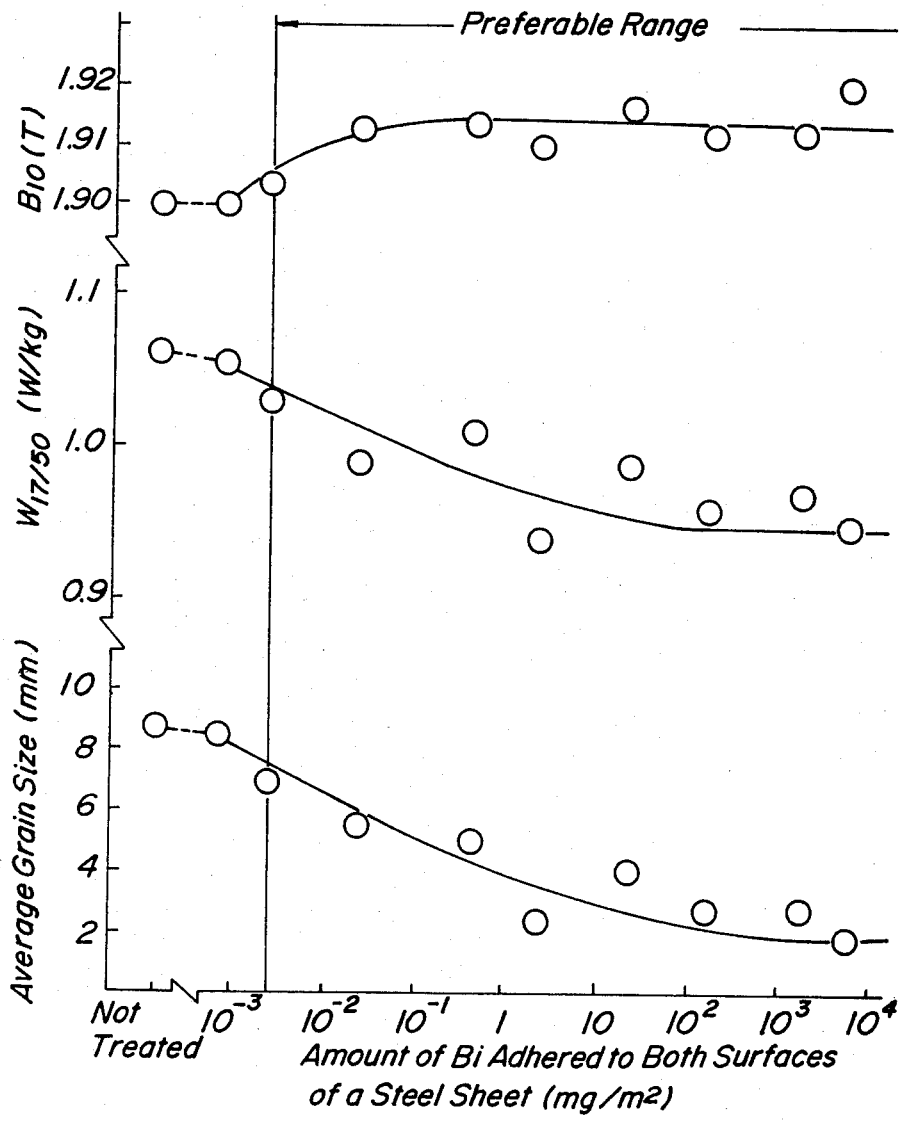
FIG. 1 is a graph illustrating relations between the amount of Bi adhered to silicon steel sheet surfaces before the decarburization annealing, and the magnetic induction, iron loss or average grain size of the resulting grain-oriented silicon steel sheet.

In the present invention, as the compounds containing Ge, Sn, Pb, As, Bi or Zn, the following compounds are preferably used;

Ge-containing compound:

$GeO_2$, $GeCl_4$ and the like

Sn-containing compound:

$SnS$, $SnSO_4$, $SnO_2$, $Na_2SnO_3$, $Sn(NO_3)_2$ and the like

Pb-containing compound:

$PbO_2$, $PbS$, $PbSO_4$ and the like

As-containing compound:

$As_2O_5$, $As_2O_3$, $As_2S_3$, $NaAsO_2$ and the like

Bi-containing compound:

$Bi_2(SO_4)_3$, $BiS$, $NaBiO_3$, $Bi_2O_3$, $Bi(NO_3)_2$ and the like

Zn-containing compound:

$ZnS$, $ZnSO_4$, $ZnO$ and the like

In the present invention, the above described elements and compounds containing these elements are adhered to the surfaces of the finally cold rolled steel sheet before or after the steel sheet is subjected to the decarburization annealing. When the element or the compound is adhered to the steel sheet surfaces before the decarburization annealing, it is advantageous that the element or the compound is adhered to both surfaces of the steel sheet in an amount of at least 2 $\mu g/m^2$ calculated as element; and when the element or the compound is adhered to the surfaces of the decarburized steel sheet, it is advantageous that the element or the compound is adhered to both surfaces of the steel sheet in an amount of at least 10 $\mu g/m^2$ calculated as element.

When an annealing separator consisting mainly of MgO and further containing Bi or a Bi-containing compound is used, the amount of Bi or Bi-containing compound to be contained in the annealing separator is preferably about 0.1–5.0% calculated as Bi (in the specification, abstract of the disclosure and claims, "%" relating to amount means "% by weight" unless otherwise indicated).

The first aspect of the present invention will be explained referring to experimental data shown in FIGS. 1 and 2.

A hot rolled silicon steel sheet having a thickness of 3.0 mm and having a composition containing C: 0.049%, Si: 3.2%, Mn: 0.06% and further containing Se: 0.025% and Sb: 0.050% was annealed at 1,000° C. for 1 minute and then subjected to two stage cold rolling with an intermediate annealing at 950° C. for 2 minutes to produce a cold rolled sheet having a final gauge of 0.30 mm. The finally cold rolled sheet was degreased, immersed in an aqueous dispersion of $NaBiO_3$, and then subjected to a decarburization annealing for 3 minutes in wet hydrogen kept at 830° C. The decarburized sheet was applied with an annealing separator consisting mainly of MgO, and then subjected to a final annealing at 1,200° C. for 5 hours under hydrogen atmosphere. In the above described immersion treatment, the concentration of $NaBiO_3$, the temperature of the dispersion, and the immersing time were controlled so as to change variously the amount of Bi to be adhered to the steel sheet surfaces. Further, during the final annealing, secondary recrystallization texture was fully developed within the temperature range of 820°–900° C.

FIG. 1 shows the influence of the adhered amount of Bi to the steel sheet surfaces upon the grain size and magnetic properties of the resulting grain-oriented silicon steel sheet.

It can be seen from FIG. 1 that, when at least 2 $\mu g/m^2$ of Bi is adhered to steel sheet surfaces before the decarburization annealing, the grain size of the product steel sheet becomes effectively small, the magnetic induction $B_{10}$ thereof improves, and as the result the iron loss $W_{17/50}$ thereof decreases considerably.

Similarly, a hot rolled silicon steel sheet having a thickness of 3.0 mm and having a composition containing C: 0.049%, Si: 3.2%, Mn: 0.06% and further containing inhibitors A–D shown in the following Table 1 was annealed at 1,000° C. for 1 minute, and then subjected to two stage cold rolling with an intermediate annealing at 950° C. for 2 minutes to produce a finally cold rolled sheet having a final gauge of 0.30 mm. The finally cold rolled sheet, after degreasing, was immersed in an aqueous solution of $SnSO_4$, and then subjected to a decarburization annealing for 3 minutes in wet hydrogen kept at 830° C., and the decarburized steel sheet was applied with an annealing separator consisting mainly of MgO and then subjected to a final annealing at 1,200° C. for 5 hours under hydrogen atmosphere.

TABLE 1

| Inhibitor | (wt. %) S | Se | Te | Sb |
|---|---|---|---|---|
| A | 0.004 | — | 0.008 | 0.031 |
| B | 0.022 | — | — | 0.029 |
| C | 0.005 | 0.020 | — | 0.027 |
| D | 0.025 | — | — | — |

In the above described immersion treatment in the aqueous $SnSO_4$ solution, the concentration of $SnSO_4$, the temperature of the solution and the immersing time were controlled so as to change variously the amount of Sn to be adhered to the steel sheet surfaces. Further, during the final annealing, the secondary recrystallization texture was fully developed within the temperature range of 820°–900° C.

Figure 2:
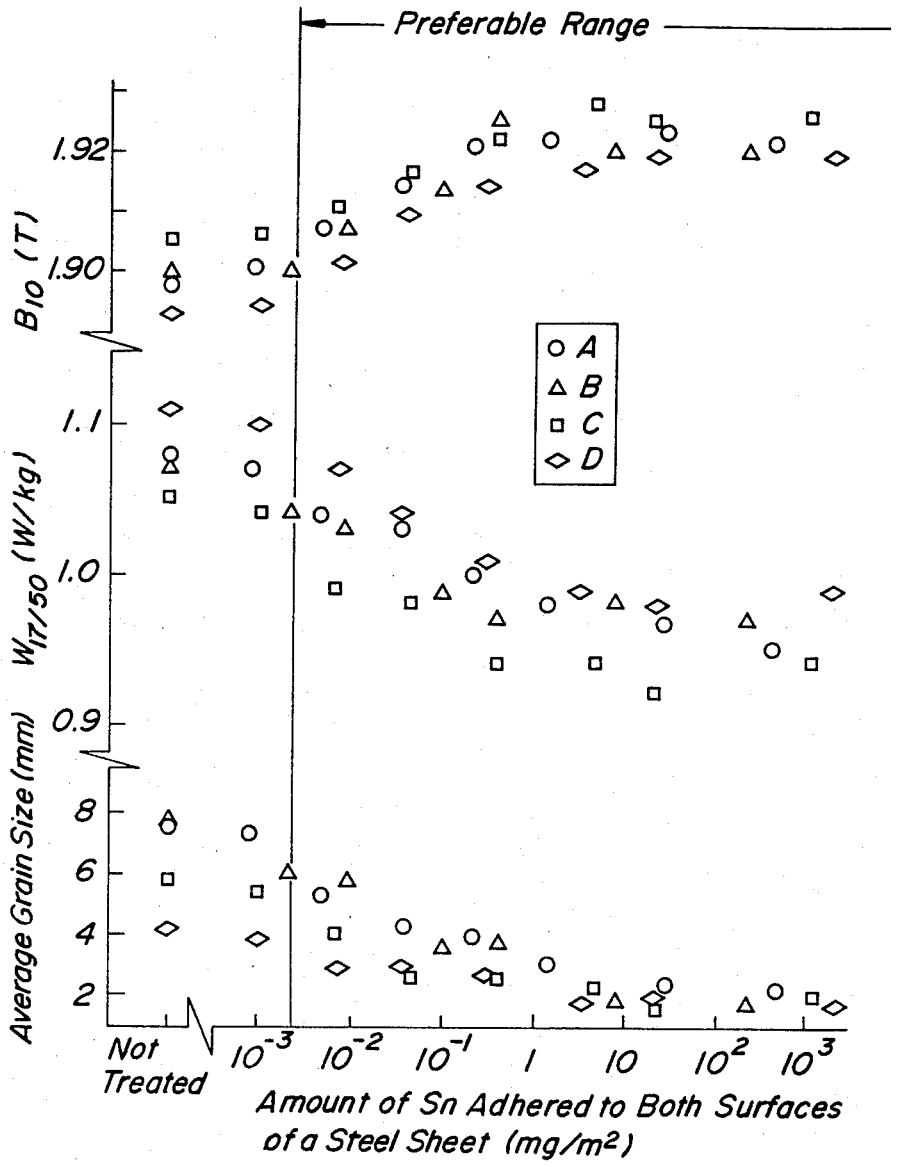
FIG. 2 is a graph similar to that of FIG. 1 and illustrating relations between the amount of Sn adhered to silicon steel sheet surfaces before the decarburization annealing, and the magnetic induction, iron loss or average grain size of the resulting grain-oriented silicon steel sheet.

FIG. 2 shows the influence of the amount of Sn adhered to the steel sheet surfaces upon the grain size and magnetic properties in the resulting grain-oriented silicon steel sheet.

It can be seen from FIG. 2 that, when at least 2 $\mu g/m^2$ of Sn is adhered to steel sheet surfaces before the decarburization annealing, the grain size in the product steel sheet becomes small, and the magnetic induction $B_{10}$ thereof improves, and as the result the iron loss $W_{17/50}$ thereof lowers considerably.

The above described experiments explain the effect of the use of Bi- or Sn-containing compound as a surface treating agent. However, the inventors have made the same experiments as described above by using elements of Bi, Sn, Ge, Pb, As, and Zn and compounds containing Ge, Pb, As and Zn, and have examined the influence of these elements and compounds containing Ge, Pb, As and Zn, adhered to the surfaces of the finally cold rolled steel sheet before the decarburization annealing upon the magnetic properties of the resulting grain-oriented silicon steel sheet, and ascertained that the same results as those shown in FIGS. 1 and 2 are obtained.

The second aspect of the present invention will be explained referring to experimental data shown in FIG. 3.

A hot rolled silicon steel sheet having a thickness of 3.0 mm and having a composition containing C: 0.049%, Si: 3.2%, Mn: 0.06% and further containing Se: 0.025% and Sb: 0.050% was annealed at 1,000° C. for 1 minute and then subjected to two stage cold rollings with an intermediate annealing at 950° C. for 2 minutes to produce a finally cold rolled steel sheet having a final gauge of 0.3 mm. The finally cold rolled sheet was degreased, and then subjected to a decarburization annealing for 3 minutes in wet hydrogen kept at 830° C., and further immersed in an aqueous dispersion of $PbO_2$. The immersion-treated steel sheet was applied with an annealing separator consisting mainly of MgO, and then subjected to a final annealing at 1,200° C. for 5 hours under hydrogen atmosphere. In the immersion treatment, the concentration of $PbO_2$, the temperature of the dispersion, and the immersing time were controlled so as to change variously the amount of $PbO_2$ to be adhered to the steel sheet surfaces. Further, during the final annealing, secondary recrystallization texture was fully developed within the temperature range of 820°–900° C.

Figure 3:
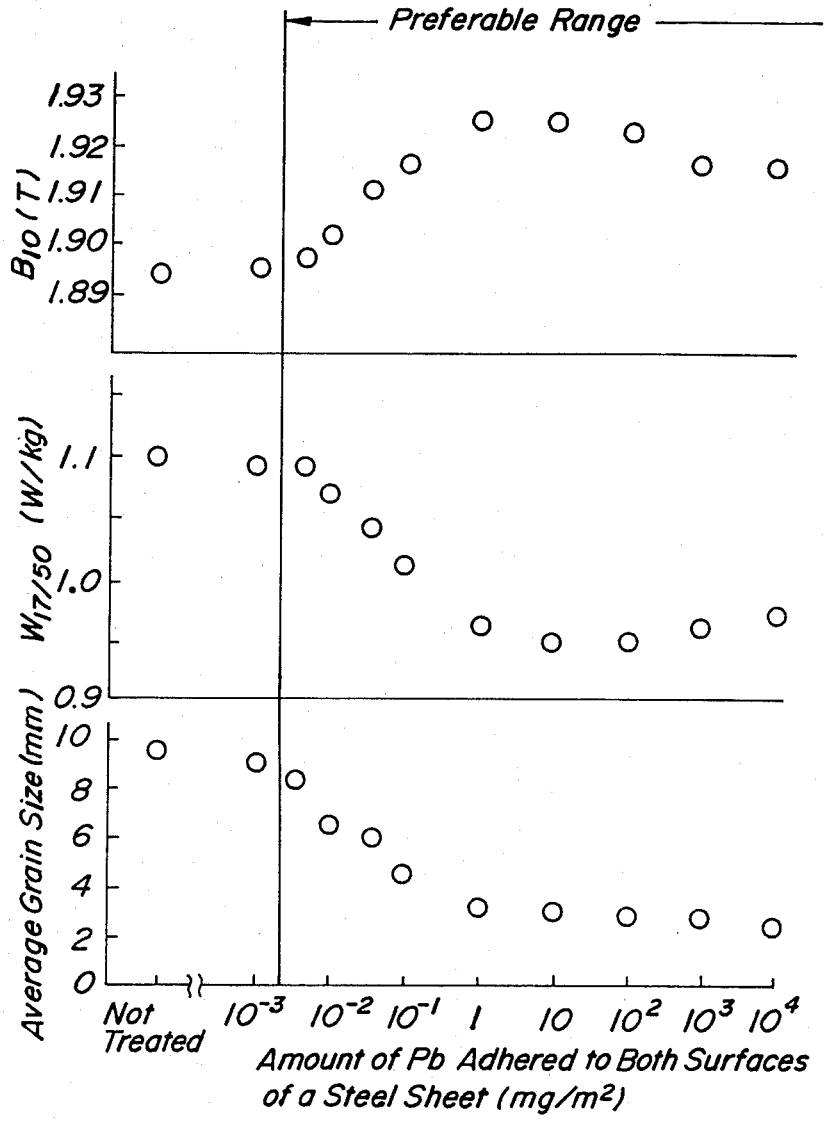
FIG. 3 is a graph illustrating relations between the amount of Pb adhered to silicon steel sheet surfaces after the decarburization annealing, and the magnetic induction, iron loss or average grain size of the resulting grain-oriented silicon steel sheet.

FIG. 3 shows the influence of the amount of Pb adhered to decarburized steel sheet surfaces upon the magnetic properties of the resulting grain-oriented silicon steel sheet.

It can be seen from FIG. 3 that, when at least 10 $\mu g/m^2$ of Pb is adhered to the decarburized steel sheet surfaces before the final annealing of the sheet, the crystal grain size of the product steel sheet becomes small, the magnetic induction $B_{10}$ thereof improves, and as the result the iron loss $W_{17/50}$ thereof lowers considerably.

The inventors have made the same experiment as described above with respect to elements of Pb, Ge, Sb, As, Zn and Bi and compounds containing Ge, Sb, As, Zn and Bi, and ascertained that the same result as that shown in FIG. 3 is obtained.

One embodiment of the third aspect of the present invention will be explained hereinafter referring to experimental data shown in FIG. 4.

A hot rolled silicon steel sheet having a thickness of 2.5 mm and having a composition containing C: 0.049%, Si: 3.2%, Mn: 0.06% and further containing Se: 0.025% and Sb: 0.050% was annealed at 1,000° C. for 1 minute and then subjected to two stage cold rollings with an intermediate annealing at 970° C. for 2 minutes to produce a finally cold rolled sheet having a final gauge of 0.27 mm. The finally cold rolled sheet, after degreasing, was immersed for 10 seconds in an aqueous dispersion containing 100 mg/l of ZnO and kept at 30° C., and then squeezed by means of a pair of rubber rolls, and dried in an air bath kept at 200° C. to adjust the amount of Zn to be adhered to the steel sheet surfaces to 4.1 $mg/m^2$. The thus treated steel sheet was subjected to a preliminary annealing at a temperature within the range of 500°-700° C. for 2 minutes in dry nitrogen, and then subjected to a decarburization annealing for 3 minutes in wet hydrogen kept at 830° C. The decarburized steel sheet was applied with an annealing separator consisting mainly of MgO, and then subjected to a final annealing at 1,200° C. for 5 hours under hydrogen atmosphere to produce a grain-oriented silicon steel sheet (this method of the third aspect of the present invention is indicated by the mark • in FIG. 4).

Figure 4:
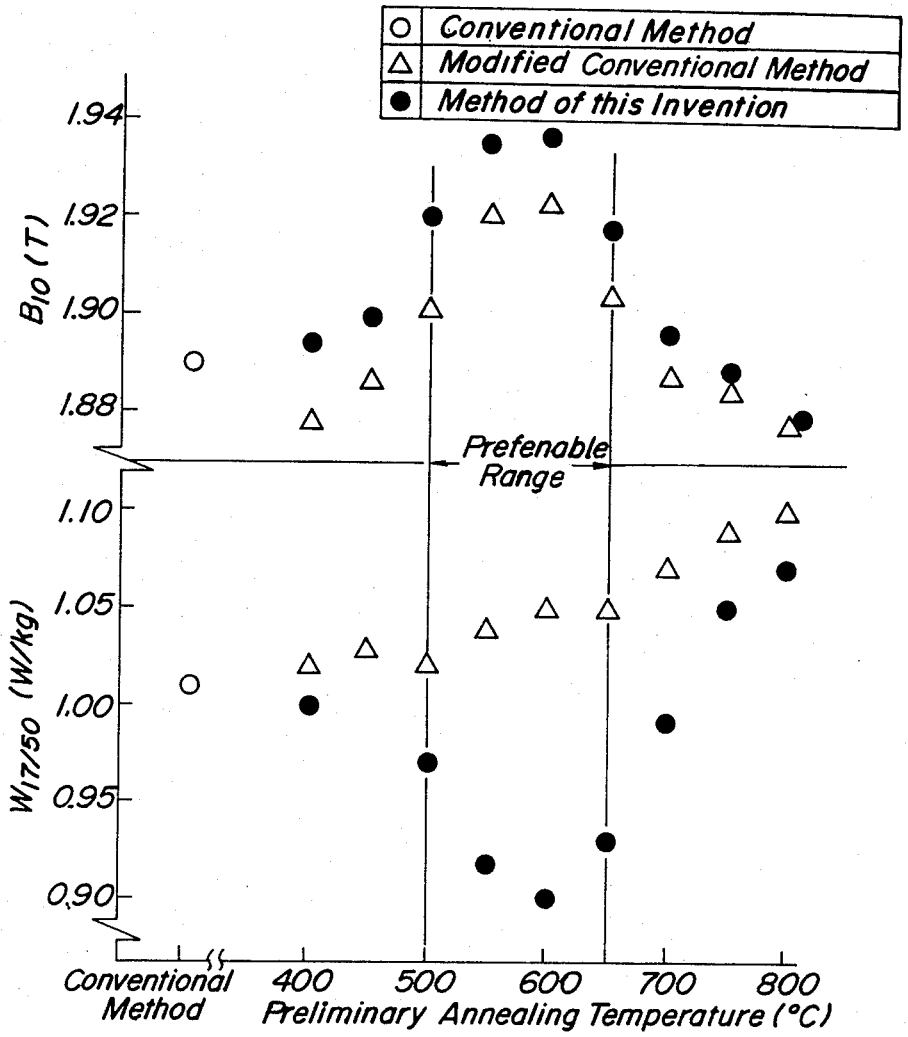
FIG. 4 is a graph illustrating the difference in the influence of the preliminary annealing temperature of a finally cold rolled silicon steel sheet upon the magnetic properties of the resulting grain-oriented silicon steel sheet between the method of the present invention, wherein a finally cold rolled steel sheet is applied with Zn and then subjected to the preliminary annealing, and a modified conventional method, wherein a finally cold rolled steel sheet is subjected to the preliminary annealing only, and further showing a comparison of the method of the present invention with the modified conventional method and a conventional method.

For comparison, the same hot rolled silicon steel sheet as described above was used, and a grain-oriented silicon steel sheet was produced in the same manner as described above, except that the finally cold rolled and degreased steel sheet was directly subjected to the decarburization annealing without carrying out both the adhesion treatment of Zn and the preliminary annealing (this method is a conventional method and is indicated by the mark o in FIG. 4).

Further, the same hot rolled silicon steel sheet as described above was used, and a grain-oriented silicon steel sheet was produced in the same manner as described above, except that the finally cold rolled and degreased steel sheet was subjected to the preliminary annealing without carrying out the adhesion treatment of Zn, and then subjected to the decarburization annealing (this method is a modified conventional method and is indicated by the mark Δ in FIG. 4).

It can be seen from FIG. 4 that the modified conventional method (indicated by the mark Δ) is remarkably effective for improving the $B_{10}$ value of the resulting grain-oriented silicon steel sheet as compared with the conventional method (indicated by the mark o), but still has a drawback that the resulting grain-oriented silicon steel sheet is rather high in the iron loss value as compared wih the conventional method due to the reason that the modified conventional method forms coarse secondary recrystallization structure having a remarkably large grain size. On the contrary, according to the method of the third aspect of the present invention (indicated by the mark •), the resulting grain-oriented silicon steel sheet has not coarse crystal grains, but rather has small crystal grains, and as the result the grain-oriented silicon steel sheet has remarkably low iron loss value and further has remarkably high $B_{10}$ value.

This preliminary annealing is carried out at a temperature within the range of 500°-700° C., preferably 500°-650° C., for 0.5-10 minutes. The reason is as follows. The recrystallization begins generally at about 550° C., and proceeds rapidly corresponding to the temperature rising, and a recrystallization texture preferable for the magnetic properties of the resulting grain-oriented silicon steel sheet can be obtained at a temperature of not higher than 650° C. In the preliminary annealing, when the annealing temperature is low, a long time treatment is effective for the annealing; and when the annealing temperature is high, a short time treatment is effective for the annealing. However, a preliminary annealing for less than 0.5 minute or more than 10 minutes can not result in a satisfactory recrystallization texture, and the magnetic properties of the product steel sheet can not be improved.

In the above described experiments, the effect of the use of a Zn-containing compound as a surface-treating agent has been explained. However, the inventors have made the same experiments as described above with respect to elements of Zn, Ge, Sn, Pb, As and Bi, and compounds containing Ge, Sn, Pb, As and Bi, and have ascertained that the same results as shown in FIG. 4 is obtained.

Further, another embodiment of the third aspect of the present invention will be explained referring to experimental data shown in FIG. 5.

A hot rolled silicon steel sheet having a thickness of 2.2 mm and having the same composition as described above was annealed at 1,000° C. for 1 minute, and then subjected to two stage cold rollings with an intermediate annealing at 970° C. for 2 minutes to produce a finally cold rolled sheet having a final gauge of 0.23 mm. The finally cold rolled steel sheet, after degreasing, was subjected to a preliminary annealing wherein the steel sheet was heated at a heating rate of 100° C./min. within the temperature range of 500°-700° C., and then immersed in an aqueous dispersion of ZnO such that the amount of ZnO to be adhered to both surfaces of the steel sheet would be within the range of $10^{-3}$ mg/m$^2$-$10^4$ mg/m$^2$. The immersion-treated sheet was subjected to a decarburization annealing for 3 minutes in wet hydrogen kept at 830° C., then applied with an annealing separator consisting mainly of MgO, and then subjected to a final annealing at 1,200° C. for 5 hours under hydrogen atmosphere to produce a grain-oriented silicon steel sheet (this method of the third aspect of the present invention is indicated by the mark ▲ in FIG. 5).

Figure 5:
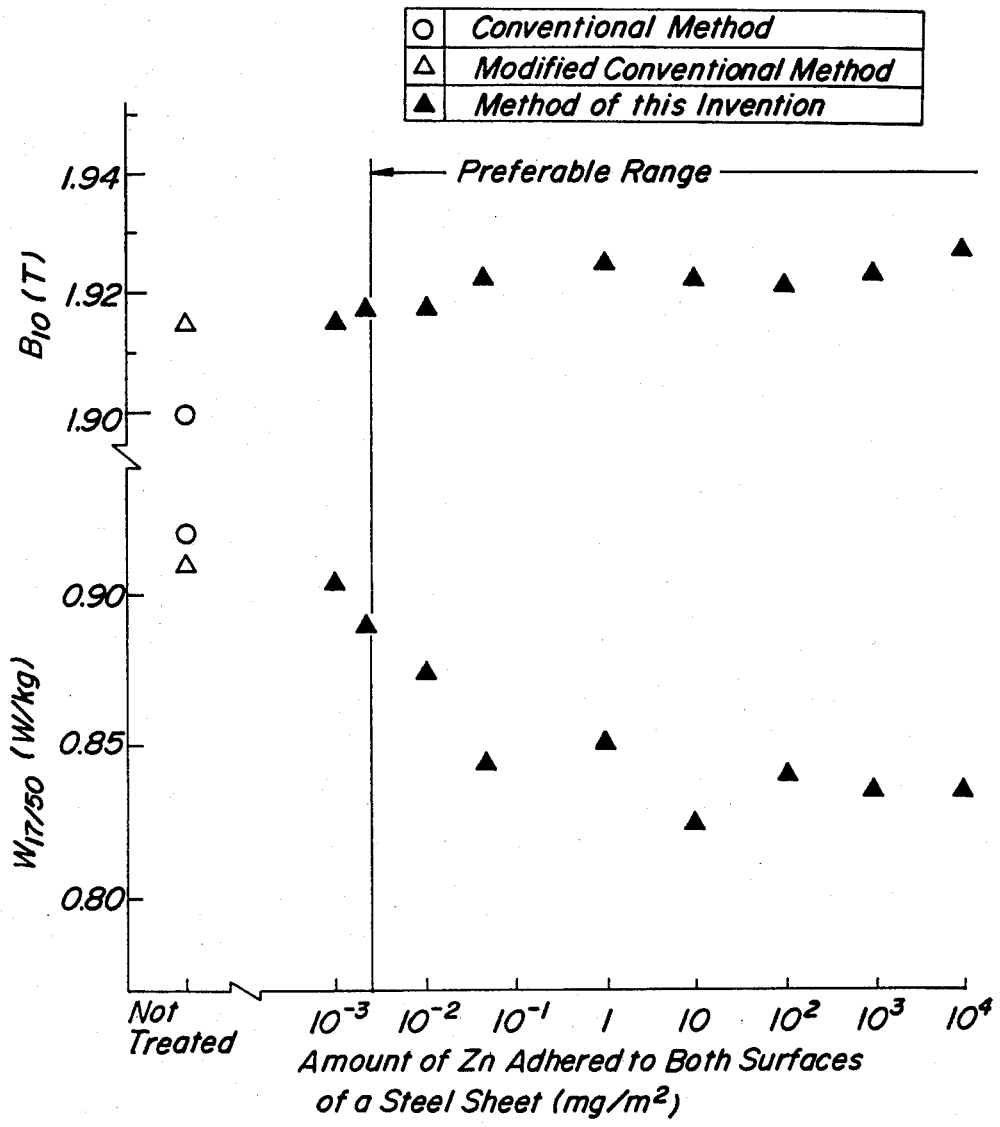
FIG. 5 is a graph illustrating the influence of the variant amount of Zn adhered to the surfaces of a preliminarily annealed steel sheet before the decarburization annealing upon the magnetic properties of the resulting grain-oriented silicon steel sheet in the method of the present invention, and further showing a comparison of the method of the present invention with the modified conventional method and the conventional method.

For comparison, the same hot rolled silicon steel sheet as described above was used, and a grain-oriented silicon steel sheet was produced in the same manner as described above, except that the finally cold rolled and degreased steel sheet was directly subjected to the decarburization annealing without carrying out both the preliminary annealing and the adhesion treatment of Zn to the steel sheet surfaces (this method is a conventional method and is indicated by the mark o in FIG. 5).

Further, the same hot rolled silicon steel sheet as described above was used, and a grain-oriented silicon steel sheet was produced in the same manner as described above, except that the finally cold rolled and degreased steel sheet was subjected to the preliminary annealing and then to the decarburization annealing without carrying out the adhesion treatment of Zn to the steel sheet surfaces (this method is a modified conventional method and is indicated by the mark Δ in FIG. 5).

FIG. 5 shows the magnetic properties of the resulting products.

It can be seen from FIG. 5 that the product obtained by the modified conventional method (indicated by the mark Δ) has remarkably higher magnetic induction $B_{10}$ than that of the product obtained by the conventional method (indicated by the mark o), but has not satisfactorily low iron loss due to the development of coarse crystal grains. On the contrary, the product obtained by the method (indicated by the mark ▲) satisfying the conditions defined in the present invention has remarkably low iron loss value due to the small crystal grain size in the product and further has remarkably high magnetic induction $B_{10}$.

In the above described experiments, the effect of the use of a Zn-containing compound as a surface-treating agent has been explained. However, the inventors have made the same experiments as described above with respect to elements of Zn, Ge, Sn, Pb, As and Bi, and compounds containing Ge, Sn, Pb, As and Bi, and have ascertained that the same results as shown in FIG. 5 is obtained.

The fourth aspect of the present invention will be explained referring to experimental data shown in FIG. 6.

A hot rolled silicon steel sheet having a thickness of 2.0 mm and having a composition containing C: 0.049%, Si: 3.2%, Mi: 0.06% and further containing Se: 0.025% and Sb: 0.050% was annealed at 1,000° C. for 1 minute and then subjected to two stage cold rolling with an intermediate annealing at 950° C. for 2 minutes to produce a finally cold rolled sheet having a final gauge of 0.23 mm. The finally cold rolled sheet, after degreasing, was subjected to a decarburization annealing for 3 minutes in wet hydrogen kept at 830° C., then applied with an annealing separator consisting mainly of MgO, and further subjected to a final annealing at 1,200° C. for 5 hours under hydrogen atmosphere to produce a grain-oriented silicon steel sheet. In the application of the annealing separator, a variant amount of $Bi_2(SO_4)_3$ was contained in the annealing separator consisting mainly of MgO. Further, during the final annealing, secondary recrystallization texture was fully developed within the temperature range of 820°-900° C.

Figure 6:
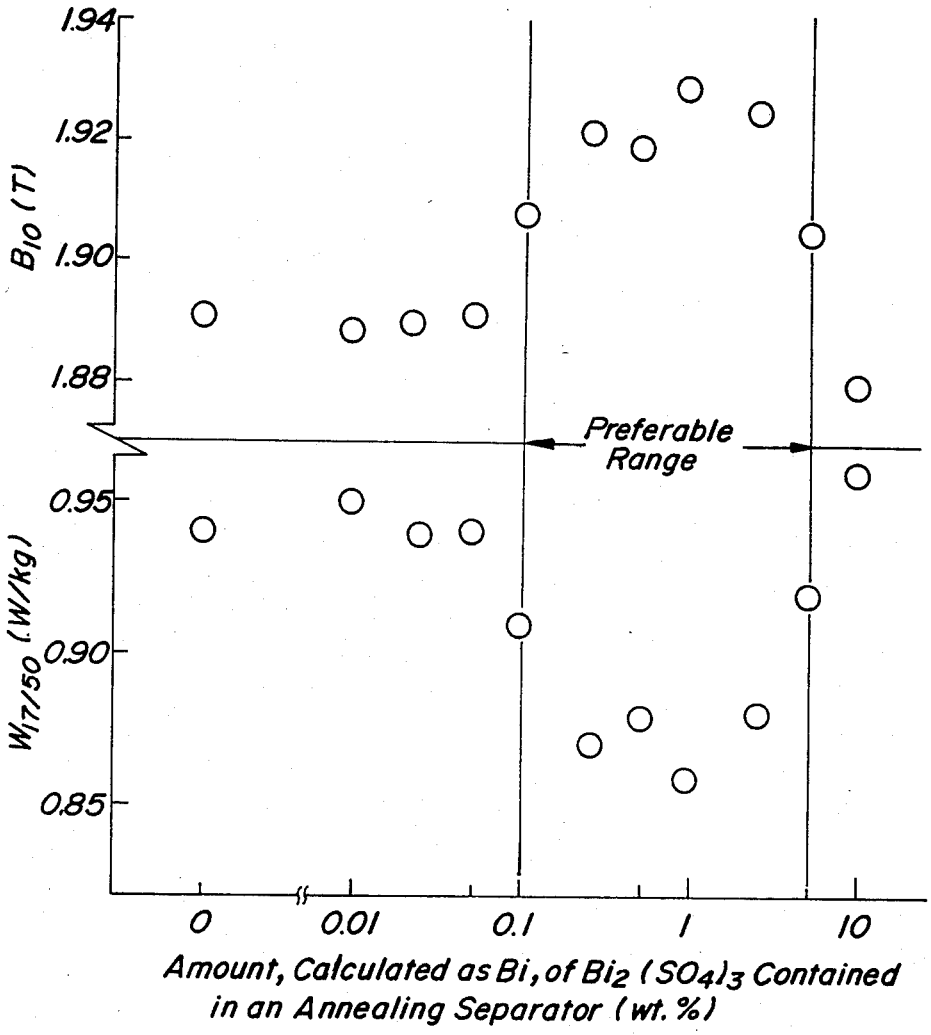
FIG. 6 is a graph illustrating relations between the amount, calculated as Bi, of $Bi_2(SO_4)_3$ contained in an annealing separator, and the iron loss of magnetic induction of the resulting grain-oriented silicon steel sheet.

FIG. 6 illustrates the influence of the content of $Bi_2(SO_4)_3$ in the annealing separator upon the magnetic properties of the resulting grain-oriented silicon steel sheet. It can be seen from FIG. 6 that, when an annealing separator contains 0.1-5.0%, calculated as Bi, of $Bi_2(SO_4)_3$, the product steel sheet has satisfactorily high magnetic induction $B_{10}$ and low iron loss $W_{17/50}$. Bi-containing compounds other than the above described $Bi_2(SO_4)_3$ exhibited the same effect as that of $Bi_2(SO_4)_3$, and when the content of a Bi-containing compound in an annealing separator was less than 0.1% calculated as Bi, the effect of the Bi-containing compound hardly appeared, and when the content exceeded 5%, secondary recrystallized grains in the product steel sheet were not uniformly oriented, and the product steel sheet was poor in magnetic properties and further was poor in surface appearance due to the formation of spot-like flaws.

The present invention will be explained in more detail following to the production steps.

As to the composition of the starting silicon steel, it is desirable that the steel contains Si: 2.5-4.0%, C: 0.02-0.06% and Mn: 0.02-0.20% and further contains at least one of S: 0.005-0.05%, Se: 0.005-0.05% and Te: 0.003-0.05%. Si is used for obtaining satisfactorily low iron loss without sacrificing the yield in the cold rolling, C is used for forming fine crystal grains in the steps carried out after hot rolling, and the other ingredients are used for inhibiting effectively the growth of primary recrystallization grains. It is desirable that the starting silicon steel contains the above described ingredients in the above described range. However, even when the amounts are outside of the above described ranges, the ingredients are somewhat effective.

The starting silicon steel to be used in the present invention has a composition consisting of the above described ingredients and the remainder being substantially Fe and incidental impurities. However, the steel may occasionally contain grain boundary seggregation elements, such as Sb, As, Bi, Sn, Pb and the like, alone or in admixture in order to improve the effect of the inhibitors. The addition of the grain boundary seggregation element has not an adverse influence upon the effect of the present invention.

The steel making method and the hot rolling method are not particularly limited, and can be carried out according to commonly known methods.

The annealing of a hot rolled sheet and the intermediate annealing in the cold rolling step are occasionally carried out at a temperature within the range of 750°-1,100° C. for a period of from 10 seconds to 10 minutes.

The hot rolled sheet, after occasionally annealed, is subjected to at least one stage cold rolling to produce a finally cold rolled sheet having a final gauge. The finally cold rolled sheet is degreased by a commonly known method, and then at least one member selected from the group consisting of elements of Ge, Sn, Pb, As, Bi and Zn and compounds containing these elements is adhered to the surfaces of the steel sheet. As the method for adhering the element or the element-containing compound to the steel sheet surfaces, there can be used any of immersion, spraying, application, electrodeposition, dropping, transfer printing and the like.

The amount of the element or the element-containing compound to be adhered to the surfaces of a steel sheet should be at least 2 $\mu g/m^2$ calculated as element. It is preferable to adhere the element or the element-containing compound to both surfaces of a steel sheet. However, it is not always necessary to adhere the element or the element-containing compound to both surfaces of a steel sheet, and even when the element or the element-containing compound is adhered to one surface of a steel sheet, the effect of the element appears. When the element or the element-containing compound is adhered to one surface of a steel sheet, it is also necessary that the amount of element adhered to one surface of the steel sheet is at least 2 $\mu g/m^2$ in order to produce a product steel sheet having excellent magnetic properties.

The above treated steel sheet is subjected to a decarburization annealing at a temperature of 700°-900° C. under an atmosphere containing hydrogen and steam until the C content in the steel sheet becomes about 0.003% or less.

In the third aspect of the present invention, prior to the above described decarburization annealing, the finally cold rolled and degreased steel sheet is subjected to such a preliminary annealing that the steel sheet is kept to a constant temperature within the range of 500°-700° C. for 0.5-10 minutes or is heated within the temperature range of 500°-700° C. at a heating rate of 50° C./min.-400° C./min. This preliminary annealing is effective for improving the primary recrystallization texture.

The preliminary annealing may be carried out before the above described adhesion treatment of element or the adhesion treatment may be carried out before and after the preliminary annealing.

According to the second aspect of the present invention, the finally cold rolled and degreased steel sheet is directly subjected to a decarburization annealing at a temperature of 700°-900° C. under an atmosphere containing hydrogen steam until the C content in the steel sheet becomes about 0.003% or less, without carrying out the adhesion treatment of element or a combination of the adhesion treatment of element and the preliminary annealing. Then, at least one member selected from the group consisting of elements of Ge, Sn, Pb, As, Bi and Zn and compounds containing these elements is adhered to the surfaces of the steel sheet. As the method for adhering the element or the element-containing compound to the steel sheet surfaces, there can be used any of immersion, spraying, application, electrodeposition, dropping, transfer printing and the like.

When the element or the compound containing the element is adhered to the decarburized steel sheet, the amount of the element or the compound containing the element to be adhered to the surfaces of the steel sheet is at least 10 $\mu g/m^2$ calculated as element. When the amount is less than 10 $\mu g/m^2$, the magnetic properties of the resulting grain-oriented silicon steel sheet can not be satisfactorily improved. In the present invention, it is not always necessary to adhere the element or the element-containing compound to both surfaces of a steel sheet, and even when the element or the element-containing compound is adhered to only one surface of a steel sheet, the effect of the element appears. When the element or the element-containing compound is adhered to one surface of a steel sheet, it is also necessary that the amount of element adhered to one surface of the steel sheet is at least 10 $\mu g/m^2$ in order to produce a product steel sheet having excellent magnetic properties.

When the finally cold rolled and degreased steel sheet is directly subjected to the decarburization annealing without carrying out the adhesion treatment of element or a combination of the adhesion treatment of element and the preliminary annealing, it is necessary to carry out the above described adhesion treatment of element after the decarburization annealing. However, when the finally cold rolled and degreased steel sheet has been subjected to the adhesion treatment of element or a combination of the adhesion treatment of element and the preliminary annealing before the decarburization annealing, the decarburized steel sheet may be occasionally subjected to the adhesion treatment of element.

The essential feature of the first, second and third aspects of the present invention lies in that the adhesion treatment of element or a combination of the adhesion treatment of element and the preliminary annealing is carried out during the course wherein the finally cold rolled and degreased steel sheet is subjected to a decarburization annealing and then applied with an annealing separator consisting mainly of MgO in a conventional method.

In the first and second aspects of the present invention, the final cold rolling, the adhesion treatment of element, and the decarburization annealing can be carried out according to the following treating orders.

(1) final cold rolling-adhesion treatment-decarburization annealing,
(2) final cold rolling-decarburization annealing-adhesion treatment, and
(3) final cold rolling-adhesion treatment-decarburization annealing-adhesion treatment.

Further, the final cold rolling, the adhesion treatment of element, the preliminary annealing and the decarburization annealing in the third aspect of the present invention can be carried out according to the following treating orders.

(4) final cold rolling-adhesion treatment-preliminary annealing-decarburization annealing,
(5) final cold rolling-preliminary annealing-adhesion treatment-decarburization annealing,
(6) final cold rolling-preliminary annealing-decarburization annealing-adhesion treatment,
(7) final cold rolling-adhesion treatment-preliminary annealing-adhesion treatment-decarburization annealing,
(8) final cold rolling-adhesion treatment-preliminary annealing-decarburizaion annealing-adhesion treatment,
(9) final cold rolling-preliminary annealing-adhesion treatment-decarburization annealing-adhesion treatment, and
(10) final cold rolling-adhesion treatment-preliminary annealing-adhesion treatment-decarburization annealing-adhesion treatment.

Of course, in the present invention, among the above described treating orders, a proper treating order must be selected depending upon the magnetic properties of the aimed product.

The inventors have made an investigation with respect to the preferable treating condition for the immersion method for adhering the element to the steel sheet surfaces. The results of the investigation will be explained hereinafter referring to FIGS. 7 and 8.

A hot rolled silicon steel sheet having a thickness of 3.0 mm and having a composition containing C: 0.049%, Si: 3.2%, Mn: 0.06% and further containing inhibitors shown in the above described Table 1 was annealed at 1,000° C. for 1 minute, and then subjected to two stage cold rolling with an intermediate annealing at 950° C. for 2 minutes to produce a finally cold rolled sheet having a final gauge of 0.30 mm. The finally cold rolled sheet, after degreasing, was immersed in an aqueous dispersion containing $NaBiO_3$ powders dispersed therein, passed through a pair of squeeze rolls and then dried. The above treated steel sheet was subjected to a decarburization annealing at 830° C. for 3 minutes in wet hydrogen, and the decarburized steel sheet was applied with an annealing separator consisting mainly of MgO, and then subjected to a final annealing at 1,200° C. for 5 hours. In the above described immersion treatment in the $NaBiO_3$ dispersion, the concentration of Bi, the temperature of the dispersion, and the immersing time were controlled so as to change variously the amount of Bi to be adhered to the steel sheet surfaces. Further, during the final annealing, secondary recrystallization texture was fully developed at a temperature within the range of 820°–900° C.

Figure 7:
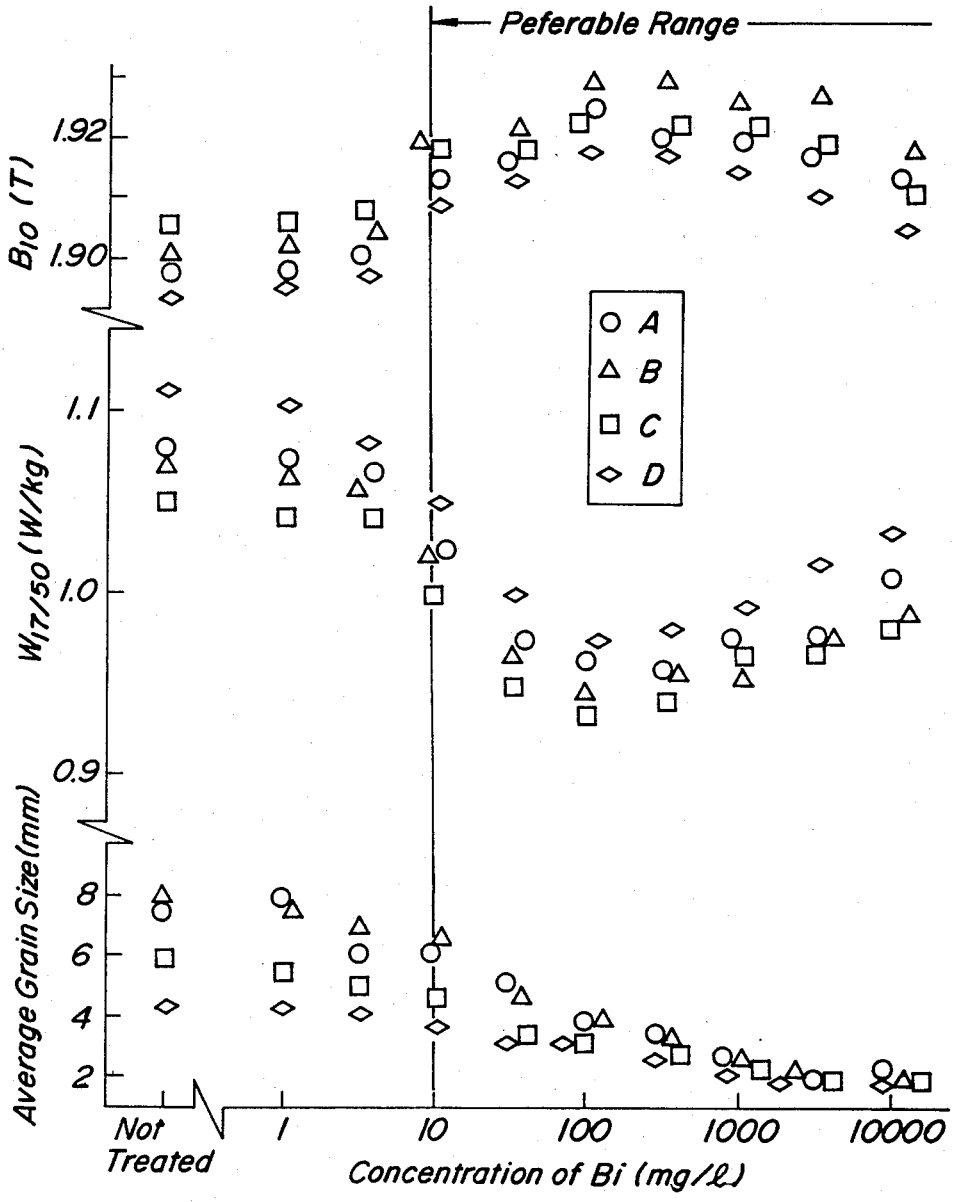
FIG. 7 is a graph illustrating relations between the concentration of Bi in a treating liquid for immersing a finally cold rolled steel sheet before the decarburization annealing, and the magnetic induction, iron loss or average grain size of the resulting grain-oriented silicon steel sheet.

FIG. 7 illustrates relations between the concentration of Bi in the aqueous $NaBiO_3$ dispersion, and the magnetic properties of the resulting grain-oriented silicon steel sheet (final gauge: 0.30 mm).

It can be seen from FIG. 7 that, when a finally cold rolled and degreased steel sheet is immersed in an aqueous $NaBiO_3$ dispersion having a Bi concentration of at least 10 mg/l prior to the decarburization annealing, the resulting grain-oriented silicon steel sheet has small grain size, high magnetic induction and further considerably low iron loss independently of the kind of inhibitors.

It has been ascertained from experiments that, even when an application method by means of a spray or fluted roll is used in place of the immersion method, substantially the same effect as described above can be obtained.

Figure 8:
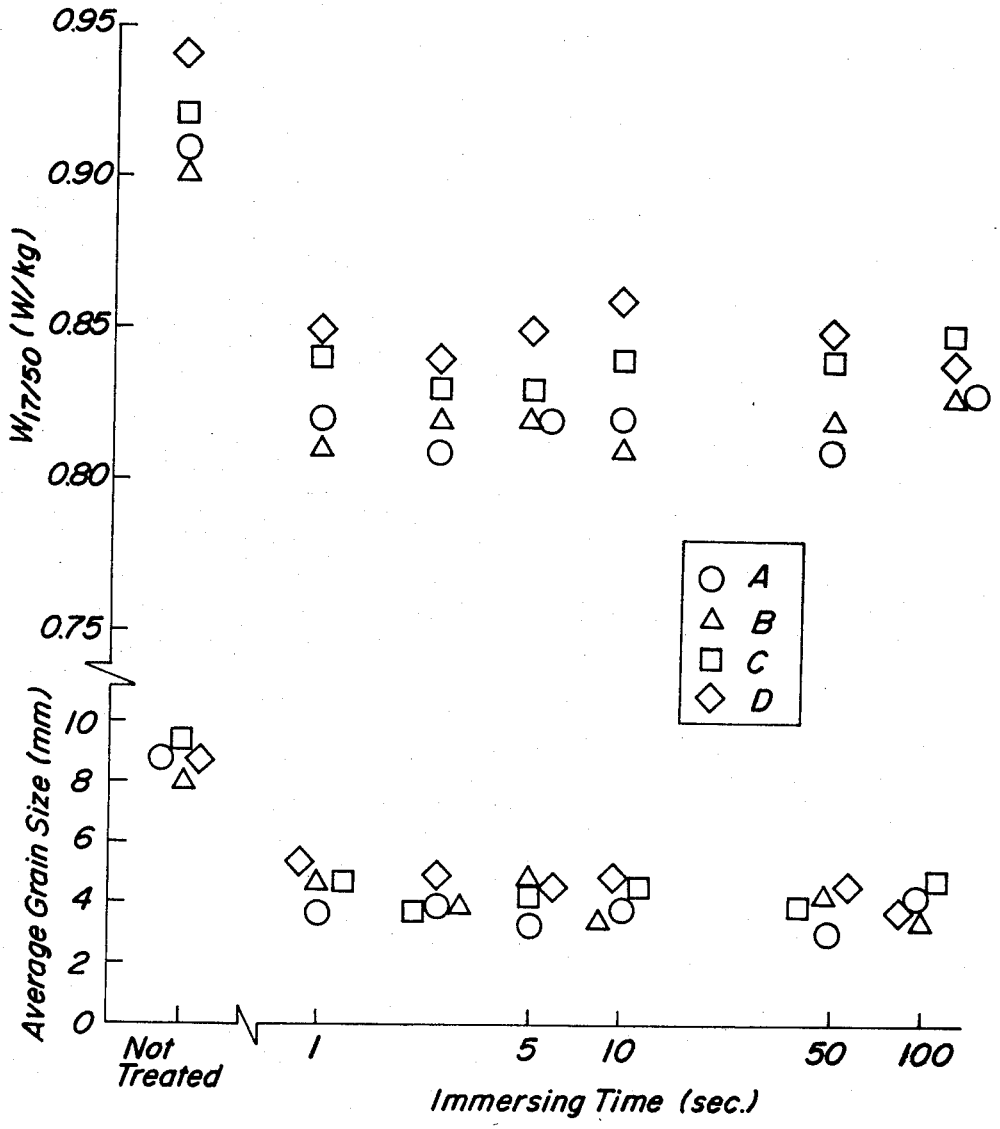
FIG. 8 is a graph illustrating relations between the immersing time of a finally cold rolled steel sheet, and the iron loss or average grain size of the resulting grain-oriented silicon steel sheet.

FIG. 8 illustrates relations between the immersing time of a finally cold rolled and degreased steel sheet in an aqueous $NaBiO_3$ dispersion having a Bi concentration of 208 mg/l, and the grain size and iron loss value of the resulting grain-oriented silicon steel sheet (final gauge: 0.23 mm).

It can be seen from FIG. 8 that the iron loss value and grain size of the product steel sheet containing any kind of inhibitors are not substantially influenced by the immersing time, and even an immersion treatment of a short time of about 1 second is effective for attaining the object of the present invention.

Further, it has been ascertained that, even when an application method by means of a spray or fluted roll is used in place of the immersion method, substantially the same effect as described above can be obtained.

Accordingly, it is important in the immersion method that a finally cold rolld and degreased steel sheet is immersed for at least 1 second in an aqueous dispersion containing a given elements in a concentration of at least 10 mg/l. After the immersion treatment, the immersed steel sheet is passed occasionally through a pair of squeeze rolls and then dried. By this squeezing treatment, the amount of a element to be adhered to the steel sheet surfaces can be easily controlled. The drying is a very important treatment in order to give satisfactorily high rust resistance to the resulting grain-oriented silicon steel sheet and further to excellent appearance to the coating film formed on the steel sheet surfaces.

When an aqueous dispersion is used as a treating liquid, it is effective that the dispersion is formed into a sol or a colloidal dispersion in order to keep the concentration constant and to be applied uniformly to the steel sheet surfaces, or is fully stirred by means of a propeller or an ultrasonic wave.

After the finally cold rolled and degreased steel sheet is subjected to the above described adhesion treatment of element and the decarburization annealing (in the first and second aspects of this invention), or after the finally cold rolled and degreased steel sheet is subjected to the above described adhesion treatment of element, preliminary annealing and decarburization annealing (in the third aspect of this invention), the steel sheet is applied with an annealing separator consisting mainly of MgO.

According to the fourth aspect of the present invention, a finally cold rolled and degreased steel sheet is directly subjected to a decarburization annealing without carrying out the above described adhesion treatment of element or a combination of the adhesion treatment of element and the preliminary annealing, and an annealing separator consisting mainly of MgO and containing 0.1–5.0% of Bi or a Bi-containing compound is applied to the decarburized steel sheet.

Of course, the annealing separator consisting mainly of MgO and containing 0.1–5.0% of Bi or a Bi-containing compound may be applied to a decarburized steel sheet, which has already been subjected to the adhesion treatment of element or a combination of the adhesion treatment of element and the preliminary annealing in the first, second or third aspect of the present invention.

The steel sheet applied with the above described annealing separator was subjected to a final annealing comprising a recrystallization annealing at a temperature within the range of 800°–1,000° C. and a purification annealing at a temperature within the range of 1,100°–1,250° C. under hydrogen atmosphere successive to the recrystallization annealing.

After removal of the annealing separator, the finally annealed steel sheet was applied with a tension coating, and then subjected to a flattening annealing at a temperature within the range of 700°–900° C.

Japanese Patent Application Publication No. 48,567/81 discloses a technique, wherein a compound containing any one of Al, Sn, As, Pb, Sb, Bi, Se and Te is applied to the surfaces of a cold rolled low-carbon aluminum killed steel sheet in an amount of at least 2 $g/m^2$ before the annealing of the steel sheet under a nitrogen-containing atmosphere, in order to prevent the nitriding of the steel sheet during the annealing. Further, this Japanese patent application publication discloses that the use of the above described element is also effective for preventing the deterioration of the electromagnetic properties of a silicon steel sheet due to its nitriding. On the contrary, according to the present invention, the magnetic properties of a silicon steel sheet can be remarkably improved by adhering a very small amount of only several $\mu g/m^2$ of element to its surface as illustrated in FIGS. 1–3, and further the magnetic properties of silicon steel sheet can be remarkably improved even by an annealing under an atmosphere not containing $N_2$, that is, an annealing under $H_2$ or Ar atmosphere as illustrated in the following Examples 1, 2, 3, 4, 5, 7, 9, 10 and 14. Accordingly, in the present invention, magnetic properties of silicon steel are not improved by preventing its nitriding, but are improved by giving to the steel an action entirely different from the prevention of nitriding. That is, the present invention has been accomplished based on a technical idea entirely different from that disclosed in the above described Japanese Patent Application Publication No. 48,567/81.

The following examples are given for the purpose of illustration of this invention and are not intended as limitations thereof.

EXAMPLE 1

A hot rolled sheet having a thickness of 3 mm and having a composition containing C: 0.052%, Si: 3.36%, Mn: 0.065%, Se: 0.025% and Sb: 0.031% was cold rolled into a thickness of 0.80 mm, and the first cold rolled sheet was intermediately annealed at 950° C. for 1 minute and then secondly cold rolled into a final gauge of 0.30 mm. The finally cold rolled sheet, after degreasing, was immersed for 2 seconds in an aqueous solution containing 160 mg/l of $ZnSO_4$ and kept at 30° C., and then passed though a rubber a pair of squeeze rolls and then dried. The amount of Zn adhered to the dried steel sheet was 15 $mg/m^2$. Then, the above treated steel sheet was subjected to a decarburization annealing for 3 minutes in wet hydrogen kept at 830° C., and the decarburized sheet was applied with an MgO slurry. The applied sheet was dried and then subjected to a final annealing at 850° C. for 50 hours and successively at 1,200° C. for 10 hours under $H_2$ atmosphere.

The following Table 2 shows the magnetic properties and grain size of the resulting grain-oriented silicon steel sheet. For comparison, a grain-oriented silicon steel sheet was produced according to a conventional method, wherein the finally cold rolled and degreased steel sheet was not treated with the aqueous $ZnSO_4$ solution but was directly subjected to the decarburization annealing, and the magnetic properties and grain size of the product steel sheet are also shown in Table 2.

TABLE 2

| Properties | $W_{17/50}$ (W/kg) | $B_{10}$ (T) | Grain size (mm) |
|---|---|---|---|
| Example | 0.94 | 1.913 | 2.3 |
| Comparative example | 1.01 | 1.908 | 6.5 |

It can be seen from Table 2 that, when Zn is adhered to the steel sheet surfaces before the decarburization annealing, the product steel sheet has small grain size, high magnetic induction and further considerably low iron loss.

EXAMPLE 2

A hot rolled sheet having a thickness of 2 mm and having a composition containing C: 0.040%, Si: 3.05%, Mn: 0.08%, S: 0.021% and Te: 0.005% was cold rolled into a thickness of 0.60 mm, and the first cold rolled sheet was intermediately annealed at 900° C. for 1 minute and then secondly cold colled into a final gauge of 0.23 mm. The finally cold rolled sheet, after degreasing, was immersed for 5 seconds in an aqueous dispersion containing 1 g/l of finely divided $GeO_2$ and kept at 80° C., and then dried. In this immersion treatment, $GeO_2$ was adhered to the surfaces of the steel sheet in an amount of 1 mg/m$^2$. The above treated steel sheet was subjected to a decarburization annealing in wet hydrogen kept at 830° C., and the decarburized sheet was applied with an MgO slurry. The applied sheet was dried and then subjected to a final annealing at 880° C. for 20 hours under Ar atmosphere and successively at 1,200° C. for 10 hours under $H_2$ atmosphere.

The following Table 3 shows the magnetic properties and grain size of the resulting grain-oriented silicon steel sheet together with those of a comparative grain-oriented silicon steel sheet produced by a conventional method.

TABLE 3

| Properties | $W_{17/50}$ (W/kg) | $B_{10}$ (T) | Grain size (mm) |
|---|---|---|---|
| Example | 0.79 | 1.922 | 3.2 |
| Comparative example | 0.89 | 1.901 | 8.4 |

It can be seen from the Table 3 that, when a Ge-containing compound is applied to the steel sheet surfaces before the decarburization annealing, the product steel sheet has small grain size, high magnetic induction and further considerably low iron loss.

EXAMPLE 3

A hot rolled sheet having a thickness of 2.0 mm and having a composition containing C: 0.048%, Si: 3.4%, Mn: 0.07%, Se: 0.02% and Sb: 0.03% was cold rolled into a final gauge of 0.60 mm. After degreasing, the finally cold rolled sheet was immersed for 1 minute in an aqueous dispersion containing 300 mg/l of $PbSO_4$ and kept at 80° C., and then passed through a pair of rubber squeeze rolls. The squeezed sheet was dried in an air bath kept at 150° C. The amount of PbO adhered to both surfaces of the dried steel sheet was 1 mg/m$^2$. Then, the above treated steel sheet was subjected to a decarburization annealing at 840° C. for 3 minutes under at atmosphere consisting of 50% by volume of $H_2$ and the remainder being $N_2$ and having a dew point of 60° C., and then applied with an MgO slurry, and further subjected to a final annealing at 880° C. for 30 hours under $H_2$ atmosphere and successively at 1,200° C. for 10 hours under $H_2$ atmosphere.

The following Table 4 shows the magnetic properties and grain size of the product steel sheet together with those of a comparative product steel sheet produced with the adhesion of Pb to the steel sheet surfaces according to the conventional method.

TABLE 4

| Properties | $W_{17/50}$ (W/kg) | $B_{10}$ (T) | Grain size (mm) |
|---|---|---|---|
| Example | 0.79 | 1.913 | 2.4 |
| Comparative example | 0.88 | 1.905 | 5.8 |

It can be seen from Table 4 that, when the finally cold rolled sheet is treated with a Pb-containing dispersion, the product steel sheet has very small crystal grain size and considerably low iron loss.

EXAMPLE 4

A hot rolled sheet having a thickness of 3 mm and having a composition containing C: 0.051%, Si: 3.34%, Mn: 0.067%, S: 0.027% and Sb: 0.032% was cold rolled into a thickness of 0.80 mm, and the first cold rolled sheet was intermediately annealed at 950° C. for 1 minute and then secondly cold rolled into a final gauge of 0.3 mm. After degreasing, the finally cold rolled sheet was immersed for 3 seconds in an aqueous dispersion containing 130 mg/l (75 mg/l calculated as As) of $NaAsO_2$ and kept at 30° C., passed through a pair of rubber squeeze rolls, and then dried. The above treated steel sheet was subjected to a decarburization annealing at 830° C. for 3 minutes in wet hydrogen, and the decarburized sheet was applied with an MgO slurry. After drying, the applied sheet was subjected to a final annealing at 850° C. for 50 hours and successively at 1,200° C. for 10 hours under $H_2$ atmosphere.

The following Table 5 shows the magnetic properties and grain size of the resulting product steel sheet together with those of a comparative product steel sheet produced by a conventional method.

TABLE 5

| Properties | $W_{17/50}$ (W/kg) | $B_{10}$ (T) | Grain size (mm) |
|---|---|---|---|
| Example | 0.95 | 1.920 | 2.5 |
| Comparative example | 1.03 | 1.907 | 6.8 |

It can be seen from Table 5, that when As is adhered to the steel sheet surfaces before the decarburization annealing, the resulting product steel sheet has small grain size, high magnetic induction and low iron loss, and the adhesion of As to the steel sheet surfaces is very effective.

EXAMPLE 5

A hot rolled sheet having a thickness of 3 mm and having a composition containing C: 0.040%, Si: 3.22%, Mn: 0.89%, Se: 0.028% and Sb: 0.027% was annealed at 1,000° C. for 1 minute, and then pickled. The pickled sheet was cold rolled into a thickness of 0.87 mm, and the first cold rolled sheet was intermediately annealed at 980° C. for 1 minute and then secondly cold rolled into a final gauge of 0.30 mm. After degreasing, the finally cold rolled sheet was immersed for 15 seconds in an aqueous dispersion containing 800 mg/l of $Bi_2O_3$ and kept at 30° C., and then passed through a pair of rubber squeeze rolls, and furthr dried in an air bath kept at 150° C. The amount of Bi adhered to the steel sheet surfaces was 4.9 mg/m$^2$. The above treated steel sheet was subjected to a preliminary annealing at 600° C. for 1 minute, and then to a decarburization annealing at 830° C. for 3 minutes under an atmosphere consisting of 50% by volume of $H_2$ and the remainder being $N_2$ and having a dew point of 60° C. The decarburized steel sheet was applied with an MgO slurry, and then subjected to a final annealing at 860° C. for 35 hours under Ar atmosphere and successively at 1,200° C. for 10 hours under $H_2$ atmosphere.

The following Table 6 shows the magnetic properties of the resulting grain-oriented silicon steel sheet together with those of a comparative grain-oriented silicon steel sheet produced by a conventional method.

It can be seen from Table 6 that, when a Bi salt is applied to a finally cold rolled and degreased sheet before its decarburization annealing and further a preliminary annealing is carried out at 600° C. for 1 minute during the course of heating for a decarburization annealing according to present invention, the resulting product steel sheet has remarkably low iron loss value and high $B_{10}$ value.

TABLE 6

| Magnetic properties | $W_{17/50}$ (W/kg) | $B_{10}$ (T) |
|---|---|---|
| Example | 0.96 | 1.933 |
| Comparative example | 1.04 | 1.917 |

EXAMPLE 6

A hot rolled sheet having a thickness of 2.2 mm and having a composition containing C: 0.049%, Si: 3.38%, Mn: 0.088%, S: 0.027% and Sb: 0.023% was annealed at 950° C. for 1 minute, and then pickled. The pickled sheet was cold rolled into a thickness of 0.58 mm, and the first cold rolled sheet was intermediately annealed at 980° C. for 1.5 minutes and then secondly cold rolled into a final gauge of 0.23 mm. After degreasing, the finally cold rolled sheet was subjected to a preliminary annealing at 550° C. for 4 minutes, and the preliminarily annealed sheet was immersed for 10 seconds in an aqueous dispersion containing 100 mg/l of $SnO_2$ and kept at 50° C., and then passed through a pair of rubber squeeze rolls, and further dried in an air bath kept at 200° C. The amount of Sn adhered to both surfaces of the steel sheet was 0.96 mg/m$^2$. The above treated steel sheet was subjected to a decarburization annealing at 840° C. for 3 minutes under an atmosphere consisting of 55% by volume of $H_2$ and the remainder being $N_2$ and having a dew point of 55° C. The decarburized steel sheet was applied with an MgO slurry, and then subjected to a final annealing at 870° C. for 25 hours under $N_2$ atmosphere and successively at 1,200° C. for 10 hours under $H_2$ atmosphere.

The following Table 7 shows the magnetic properties of the resulting grain-oriented silicon steel sheet together with those of a comparative grain-oriented silicon steel sheet produced by a conventinal method.

It can be seen from Table 7 that the product steel sheet of the present invention has remarkably lower iron loss value and higher $B_{10}$ value than those of the comparative product steel sheet.

TABLE 7

| Magnetic properties | $W_{17/50}$ (W/kg) | $B_{10}$ (T) |
|---|---|---|
| Example | 0.83 | 1.939 |
| Comparative example | 0.94 | 1.923 |

EXAMPLE 7

A hot rolled sheet having a thickness of 2 mm and having a composition containing C: 0.041%, Si: 3.24%, Mn: 0.089%, S: 0.027% and Te: 0.005% was annealed at 970° C. for 1 minute, and then pickled. The pickled sheet was cold rolled into a thickness of 0.50 mm, and the first cold rolled sheet was intermediately annealed at 980° C. for 1 minute and then secondly cold rolled into a final gauge of 0.20 mm. After degreasing, the finally cold rolled sheet was immersed for 20 seconds in an aqueous dispersion containing 1.5 g/l of $PbSO_4$ and kept at 80° C., and then passed through a pair of rubber squeeze rolls, and further dried in an air bath kept at 200° C. The amount of Pb adhered to both surfaces of the steel sheet was 1.25 mg/m$^2$. The above treated steel sheet was subjected to a preliminary annealing by heating the steel sheeet at a heating rate of 80° C./min. within the temperature range of 500°–700° C. under an atmosphere consisting of 55% by volume of $H_2$ and the remainder being $N_2$ and having a dew point of 60° C., and successively subjected to a decarburization annealing at 835° C. for 3 minutes under the same atmosphere as described aove. The decarburized steel sheet was applied with an MgO slurry, and then subjected to a final annealing at 860° C. for 35 hours under Ar atmosphere and successively at 1,200° C. for 10 hours under $H_2$ atmosphere.

The following Table 8 shows the magnetic properties of the resulting product steel sheet together with those of a comparative product steel sheet produced by a conventional method.

TABLE 8

| Magnetic properties | $W_{17/50}$ (W/kg) | $B_{10}$ (T) |
|---|---|---|
| Example | 0.80 | 1.946 |
| Comparative example | 0.90 | 1.930 |

EXAMPLE 8

A hot rolled sheet having a thickness of 2.5 mm and having a composition containing C: 0.07%, Si: 3.35%, Mn: 0.090% and Se: 0.024% was annealed at 950° C. for 2 minutes, and then pickled. The pickled sheet was cold rolled into a thickness of 0.71 mm, and the first cold rolled sheet was intermediately annealed at 980° C. for 1 minute and then secondly cold rolled into a final gauge of 0.27 mm. After degreasing, the finally cold rolled sheet was immersed for 11 seconds in an aqueous dispersion containing 50 mg/l of $NaAsO_2$ and kept at 25° C., and then passed through a pair of rubber squeeze rolls, and further dried in an air bath kept at 150° C. The amount of As adhered to both surfaces of the steel sheet was 150 $\mu$g/m$^2$. The above treated steel sheet was subjected to a preliminary annealing by heating the steel sheet at a heating rate of 50° C./min within the temperature range of 500°–700° C. under an atmosphere consisting of 53% by volume of $H_2$ and the remainder being $N_2$ and having a dew point of 57° C., and successively subjected to a decarburization annealing at 830° C. for 3 minutes under the same atmosphere as described above. The decarburized steel sheet was applied with an MgO slurry, and then subjected to a final annealing at 865° C. for 40 hours under $N_2$ atmosphere and successively at 1,200° C. for 10 hours under $H_2$ atmosphere.

The following Table 9 shows the magnetic properties of the product steel sheet of the present invention together with a comparative product steel sheet produced by a conventional method. It can be seen from Table 9 that the product steel sheet of the present invention has remarkably excellent magnetic properties as compared with those of the comparative product steel sheet.

TABLE 9

| Magnetic properties | $W_{17/50}$ (W/kg) | $B_{10}$ (T) |
|---|---|---|
| Example | 0.91 | 1.935 |
| Comparative example | 1.02 | 1.923 |

EXAMPLE 9

A hot rolled sheet having a thickness of 2 mm and having a composition C: 0.041%, Si: 3.05%, Mn: 0.081%, S: 0.022% and Te: 0.006% was cold rolled into a thickness of 0.60 mm, and the first cold rolled sheet was intermediately annealed at 900° C. for 1 minute and then secondly cold rolled into a final gauge of 0.23 mm. After degreasing, the finally cold rolled sheet was applied with an aqueous dispersion containing 58 mg/l of finely divided Ge and kept at 50° C. by means of a pair of fluted rolls. After left to stand for 8 seconds. the applied steel sheet was passed through a pair of rubber squeeze rolls and then dried. The above treated steel sheet was subjected to a decarburization annealing in wet hydrogen with a heat cycle consisting of a heating at 580° C. for 3 minutes and a heating at 850° C. for 3 minutes. The decarburized steel sheet was applied with an MgO slurry, dried and then subjected to a final annealing at 870° C. for 25 hours under Ar atmosphere and successively at 1,200° C. for 10 hours under $H_2$ atmosphere.

The following Table 10 shows the magnetic properties and grain size of the resulting grain-oriented silicon steel sheet together with a comparative grain-oriented silicon steel sheet produced by a conventional method.

TABLE 10

| Properties | $W_{17/50}$ (W/kg) | $B_{10}$ (T) | Grain size (mm) |
|---|---|---|---|
| Example | 0.82 | 1.949 | 3.3 |
| Comparative example | 0.94 | 1.929 | 8.6 |

It can be seen from Table 10 that a product steel sheet not only having high magnetic induction but also having very low iron loss can be obtained by applying a Ge-containing substance to a finally cold rolled and degreased steel sheet before its decarburization annealing.

EXAMPLE 10

A hot rolled sheet having a thickness of 3.0 mm and having a composition containing C: 0.047%, Si: 3.38%, Mn: 0.089%, Se: 0.027% and Sb: 0.026% was annealed at 920° C. for 3 minutes and then cold rolled into a thickness of 1.0 mm, and the first cold rolled sheet was intermediately annealed at 950° C. for 2 minutes and then secondly cold rolled into a final gauge of 0.30 mm. After degreasing, the finally cold rolled sheet was subjected to a decarburization annealing at 830° C. for 3 minutes under an atmosphere consisting of 50% by volume of $H_2$ and the remainder being $N_2$ and having a dew point of 60° C., and the decarburized steel sheet was applied with an aqueous dispersion containing 200 mg/l of $GeO_2$ and kept at 35° C. by means of a pair of fluted rolls. After left to stand for 5 seconds, the applied steel sheet was passed through a pair of rubber squeeze rolls, and then dried in an air bath kept at 180° C. The above treated steel sheet was applied with an MgO slurry, dried and then subjected to a final annealing at 870° C. for 30 hours under Ar atmosphere and successively at 1,200° C. for 10 hours under $H_2$ atmosphere.

The following Table 11 shows the magnetic properties of the resulting grain-oriented silicon steel sheet together with those of a comparative grain-oriented silicon steel sheet produced by a conventional method.

TABLE 11

| Magnetic properties | $W_{17/50}$ (W/kg) | $B_{10}$ (T) |
|---|---|---|
| Example | 0.98 | 1.924 |
| Comparative example | 1.05 | 1.905 |

It can be seen from Table 11 that, when $GeO_2$ is applied to the surfaces of a decarburized steel sheet, the resulting product steel sheet has very small crystal grain size and further remarkably excellent magnetic properties.

EXAMPLE 11

A hot rolled sheet having a thickness of 2 mm and having a composition containing C: 0.051%, Si: 3.33%, Mn: 0.069%, Se: 0.027% and Te: 0.007% was annealed at 1,000° C. for 1 minute, and then cold rolled into a thickness of 0.60 mm, and the first cold rolled sheet was intermediately annealed at 950° C. for 1 minute and then secondly cold rolled into a final gauge of 0.23 mm. The finally cold rolled sheet was subjected to a decarburization annealing at 835° C. for 3 minutes under an atmosphere consisting of 50% by volume of $H_2$ and the remainder being $N_2$ and having a dew point of 60° C., and the decarburized steel sheet was immersed for 9 seconds in an aqueous dispersion containing 200 mg/l of $SnO_2$ and kept at 30° C., and then passed through a pair of rubber squeeze rolls, and further dried in an air bath kept at 200° C. The amount of Sn adhered to the steel sheet surfaces was 3 mg/m$^2$. The above treated steel sheet was applied with an MgO slurry, and then subjected to a final annealing at 870° C. for 25 hours under $N_2$ atmosphere and successively at 1,200° C. for 10 hours under $H_2$ atmosphere.

The following Table 12 shows the magnetic properties and grain size of the resulting grain-oriented silicon steel sheet together with those of a comparative grain-oriented silicon steel sheet produced without the application of $SnO_2$ according to a conventional method.

TABLE 12

| Properties | $W_{17/50}$ (W/kg) | $B_{10}$ (T) | Grain size (mm) |
|---|---|---|---|
| Example | 0.80 | 1.929 | 2.8 |
| Comparative example | 0.95 | 1.910 | 8.9 |

It can be seen from Table 12 that an application treatment of an Sn compound to the decarburized steel sheet results in a product steel sheet having very small grain size and remarkably low iron loss.

EXAMPLE 12

A hot rolled sheet having a thickness of 3.0 mm and having a composition containing C: 0.048%, Si: 3.28%, Mn: 0.088%, S: 0.025% and Te: 0.008% was annealed at 900° C. for 3 minutes and then cold rolled into a thickness of 1.0 mm, and the first cold rolled sheet was intermediately annealed at 950° C. for 3 minutes and then secondly cold rolled into a final gauge of 0.30 mm. After degreasing, the finally cold rolled sheet was subjected to a decarburization annealing at 830° C. for 3 minutes under an atmosphere consisting of 50% by volume of $H_2$ and the remainder being $N_2$ and having a dew point of 60° C., and the decarburized steel sheet was immersed for 18 seconds in an aqueous dispersion containing 220 mg/l of $As_2S_3$ and kept at 40° C., and then passed through a pair of rubber squeeze rolls, and further dried in an air bath kept at 200° C. The amount of As adhered to the steel sheet surfaces was 1.4 g/m$^2$. Then, the above treated steel sheet was applied with an MgO slurry, dried, and then subjected to a final annealing at 865° C. for 30 hours under $N_2$ atmosphere and successively at 1,200° C. for 10 hours under $H_2$ atmosphere.

The following Table 13 shows the magnetic properties and grain size of the product steel sheet together with those of a comparative product steel sheet produced by a conventional method, and illustrates that the present invention is remarkably effective.

TABLE 13

| Properties | $W_{17/50}$ (W/kg) | $B_{10}$ (T) | Grain size (mm) |
|---|---|---|---|
| Example | 0.97 | 1.927 | 3.1 |
| Comparative example | 1.05 | 1.908 | 8.2 |

EXAMPLE 13

A hot rolled sheet having a thickness of 2.0 mm and having a composition containing C: 0.040%, Si: 3.35%, Mn: 0.068%, Se: 0.022% and Sb: 0.029% was annealed at 1,000° C. for 1 minute, and then cold rolled into a thickness of 0.60 mm, and the first cold rolled sheet was intermediately annealed at 950° C. for 1 minute and then secondly cold rolled into a final gauge of 0.23 mm. The finally cold rolled sheet was subjected to a decarburization annealing at 840° C. for 3 minutes under an atmosphere consisting of 50% by volume of $H_2$ and the remainder being $N_2$ and having a dew point of 60° C., and the decarburized steel sheet was immersed for 30 seconds in an aqueous dispersion containing 400 mg/l of $Bi_2O_3$ and kept at 80° C., and then passed through a rubber squeeze roll, and further dried in an air bath kept at 150° C. The amount of Bi adhered to the steel sheet surfaces was 2.5 mg/m$^2$. The above treated steel sheet was applied with an MgO slurry, and then subjected to a final annealing at 870° C. for 30 hours under $N_2$ atmosphere and successively at 1,200° C. for 10 hours under $H_2$ atmosphere.

The following Table 14 shows the magnetic properties and grain size of the resulting product steel sheet together with those of a comparative product steel sheet produced without the application of $Bi_2O_3$ according to a conventional method.

TABLE 14

| Properties | $W_{17/50}$ (W/kg) | $B_{10}$ (T) | Grain size (mm) |
|---|---|---|---|
| Example | 0.84 | 1.921 | 2.9 |
| Comparative example | 0.93 | 1.908 | 8.3 |

It can be seen from Table 14 that the application of a Bi salt to a decarburized steel sheet results in a product steel sheet having very small crystal grain size and remarkably low iron loss.

EXAMPLE 14

A hot rolled sheet having a thickness of 3.0 mm and having a composition containing C: 0.047%, Si: 3.28%, Mn: 0.089%, S: 0.021% and Te: 0.006% was annealed at 900° C. for 3 minutes and then cold rolled into a thickness of 1.0 mm, and the first cold rolled sheet was intermediately annealed at 950° C. for 3 minutes and then secondly cold rolled into a final gauge of 0.30 mm. After degreasing, the finally cold rolled sheet was subjected to a decarburization annealing at 830° C. for 3 minutes under an atmosphere consisting of 50% by volume of $H_2$ and remainder being $N_2$ and having a dew point of 60° C., and the decarburized steel sheet was immersed for 10 seconds in an aqueous solution containing 80 mg/l of $ZnSO_4$ and kept at 80° C., and then passed through a pair of rubber squeeze rolls, and further dried in an air bath kept at 150° C. The amount of Zn adhered to the steel sheet surfaces was 0.75 mg/m$^2$. The above treated steel sheet was applied with an MgO slurry, dried, and then subjected to a final annealing under hydrogen atmosphere, wherein the steel sheet was gradually heated at a heating rate of 2.5° C./hr from 800° C. to 900° C. and successively kept at 1,200° C. for 10 hours.

The following Table 15 shows the magnetic properties and grain size of the resulting product steel sheet together with those of a comparative product steel sheet produced by a conventional method.

TABLE 15

| Properties | $W_{17/50}$ (W/kg) | $B_{10}$ (T) | Grain size (mm) |
|---|---|---|---|
| Example | 0.97 | 1.926 | 3.5 |
| Comparative example | 1.05 | 1.911 | 8.7 |

It can be seen from Table 15 that, when a Zn-containing compound is applied to a decarburized steel sheet, the resulting product steel sheet has very small grain size and further has remarkably low iron loss.

EXAMPLE 15

A hot rolled sheet having a thickness of 2.0 mm and having a composition containing C: 0.041%, Si: 3.29%, Mn: 0.085%, Se: 0.026% and S: 0.029% was annealed at 1,000° C. for 1 minute, and then pickled. The pickled sheet was cold rolled into a thickness of 0.60 mm, and the first cold rolled sheet was intermediately annealed at 950° C. for 1 minute and then secondly cold rolled into a final gauge of 0.23 mm. The finally cold rolled sheet was subjected to a decarburization annealing at 840° C. for 3 minutes under an atmosphere consisting of 50% by volume of $H_2$ and the remainder being $N_2$ and having a dew point of 60° C. After an MgO slurry containing 1.5%, calculated as Bi, of $Bi_2O_3$ was applied onto the surfaces of the decarburized steel sheet, the steel sheet was subjected to a final annealing at 870° C. for 30 hours under $N_2$ atmosphere and successively at 1,200° C. for 10 hours under $H_2$ atmosphere.

The following Table 16 shows the magnetic properties, that is, the iron loss $W_{17/50}$ and the magnetic induction $B_{10}$, of the resulting grain-oriented silicon steel sheet together with those of a comparative grain-oriented silicon steel sheet produced by using an MgO slurry containing no $Bi_2O_3$ according to a conventional method.

TABLE 16

| Magnetic properties | $W_{17/50}$ (W/kg) | $B_{10}$ (T) |
|---|---|---|
| Example | 0.85 | 1.926 |
| Comparative example | 0.94 | 1.911 |

It can be seen from Table 16 that the application of an annealing separator containing $Bi_2O_3$ onto the decarburized steel sheet surfaces is very effective for lowering the iron loss and improving the magnetic induction of the product steel sheet.

According to the present invention, the crystal grain size of the resulting grain-oriented silicon steel sheet can be effectively made into small size, and a grain-oriented silicon steel sheet having high magnetic induction and low iron loss can be obtained.

What is claimed is:

1. In a method for producing grain-oriented silicon steel sheets, wherein a hot rolled silicon steel sheet containing at least one of S, Se and Te as an inhibitor for the growth of primary recrystallization grains is subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising adhering uniformly at least one member selected from the group consisting of elements of Ge, Sn, Pb, As, Bi and Zn and compounds containing these elements to the surfaces of the finally cold rolled steel sheet at the stage between the final cold rolling and the decarburization annealing.

2. A method according to claim 1, wherein the amount of at least one member selected from the group consisting of elements of Ge, Sn, Pb, As, Bi and Zn and compounds containing these elements adhered to both surfaces of the steel sheet is at least 2 $\mu g/m^2$ calculated as element.

3. In a method for producing grain-oriented silicon steel sheets, wherein a hot rolled silicon steel sheet containing at least one of S, Se and Te as an inhibitor for the growth of primary recrystallization grains is subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising adhering uniformly at least one member selected from the group consisting of elements of Ge, Sn, Pb, As, Bi and Az and compounds containing these elements to the surfaces of the decarburized steel sheet before the application of the annealing separator to the steel sheet surfaces.

4. A method according to claim 3, wherein the amount of at least one member selected from the group consisting of elements of Ge, Sn, Pb, As, Bi and Zn and compounds containing these elements adhered to both surfaces of the steel sheet is at least 10 $\mu g/m^2$ calculated as element.

5. In a method for producing grain-oriented silicon steel sheets, wherein a hot rolled silicon steel sheet containing at least one of S, Se and Te as an inhibitor for the growth of primary recrystallization grains is subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising carrying out a step for subjecting the finally cold rolled steel sheet to a preliminary annealing at a temperature within the range of 500°–700° C., and a step for adhering uniformly at least one member selected from the group consisting of elements of Ge, Sn, Pb, As, Bi and Zn and compounds containing these elements to the surfaces of the finally cold rolled steel sheet, before the finally cold rolled steel sheet is subjected to the decarburization annealing.

6. A method according to claim 5, wherein the step for adhering uniformly at least one member selected from the group consisting of elements of Ge, Sn, Pb, As, Bi and Zn and compounds containing these elements to the surfaces of the steel sheet is carried out before the preliminary annealing.

7. A method according to claim 5, wherein the step for subjecting the finally cold rolled steel sheet to the preliminary annealing is carried out before the step for adhering uniformly at least one member selected from the group consisting of elements of Ge, Sn, Pb, As, Bi and Zn and compounds containing these elements to the surfaces of the steel sheet.

8. A method according to claim 5, wherein the amount of at least one member selected from the group consisting of elements of Ge, Sn, Pb, As, Bi and Zn and compounds containing these elements adhered to both surfaces of the steel sheet is at least 2 $\mu g/m^2$ calculated as element.

9. In a method for producing grain-oriented silicon sheet sheets, wherein a hot rolled silicon steel sheet containing at least one of S, Se and Te as an inhibitor for the growth of primary recrystallization grains is subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising said annealing separator further containing at least one of Bi and compounds containing Bi.

10. A method according to claim 9, wherein the annealing separator contains 0.1–5.0% by weight, calculated as Bi, of at least one of Bi and compounds containing Bi.

11. In a method for producing grain-oriented silicon steel sheets, wherein a hot rolled silicon steel sheet containing at least one of S, Se and Te as an inhibitor for the growth of primary recrystallization grains is subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising adhering uniformly at least one member selected from the group consisting of elements of Ge, Sn, Pb, As, Bi and Zn and compounds containing these elements to the surfaces of the finally cold rolled steel sheet at both the stage between the final cold rolling and the decarburization annealing, and the stage between the decarburization annealing, and the application of the annealing separator to the steel sheet surfaces.

12. In a method for producing grain-oriented silicon steel sheets, wherein a hot rolled silicon steel sheet containing at least one S, Se and Te as an inhibitor for the growth of primary recrystallization grains is subjected to at least one stage cold rolling, the finally cold rolled steel sheet is subjected to a decarburization annealing, and the decarburized steel sheet is applied with an annealing separator consisting mainly of MgO and then subjected to a final annealing, the improvement comprising carrying out a step for subjecting the finally cold rolled steel sheet to a preliminary annealing at a temperature within the range of 500°-700° C., and steps for adhering uniformly at least one member selected from the group consisting of elements of Ge, Sn, Pb, As, Bi and Zn and compounds containing these elements to the surfaces of the finally cold rolled steel sheet, before and after the finally cold rolled steel sheet is subjected to the preliminary annealing.

* * * * *